United States Patent [19]

Hehn

[11] Patent Number: 4,469,231

[45] Date of Patent: Sep. 4, 1984

[54] DESK-TOP STORAGE UNIT

[75] Inventor: Bruce A. Hehn, North Canton, Ohio

[73] Assignee: Alpha Enterprises, Inc., Canton, Ohio

[21] Appl. No.: 388,745

[22] Filed: Jun. 16, 1982

[51] Int. Cl.[3] ..... A47F 5/00

[52] U.S. Cl. ..... 211/11; 108/111; 211/186; 211/188; 211/189

[58] Field of Search ..... 206/557; 220/4 F; 211/10, 11, 189, 194, 188, 186, 126; 108/111

[56] References Cited

U.S. PATENT DOCUMENTS

| | | | |
|---|---|---|---|
| 2,766,092 | 10/1956 | Dennison | 211/186 X |
| 3,326,149 | 6/1967 | Mitchell et al. | 211/186 X |
| 3,370,716 | 2/1968 | Natalis | 211/189 |
| 3,411,634 | 11/1968 | Pesce | 211/189 X |
| 4,113,329 | 9/1978 | Thurman | 211/126 X |
| 4,153,311 | 5/1979 | Takahashi | 211/186 X |

OTHER PUBLICATIONS

1981 Office Products Catalog of Spot Printing Office Equipment and Supplies, pp. 138, 140, 141, 143, 144 and 145.

1975 Office Products Catalog of Baers' Inc., pp. 107, 108, 110 and 111.

*Primary Examiner*—Ramon S. Britts
*Assistant Examiner*—Robert W. Gibson, Jr.
*Attorney, Agent, or Firm*—Oldham, Oldham, Hudak, Weber & Sand Co.

[57] ABSTRACT

A readily assembled desk-top storage unit consisting of only three separate components molded of plastic. The components include a pair of side panels, a plurality of shelves and a backing plate. The shelves have channels extending along the side edges thereof which are slidably received in aligned grooves formed in the side panels to mount the shelves on the panels. The backing plate is received in channels formed on the side panels. Outwardly projecting tabs formed on the rear edges of the shelves project into complementary-shaped slots formed in the backing plate to interlock the backing plate with the shelves. The storage unit can be placed in a first position on a supporting structure and serve as a tray for receiving papers, letters, etc. on the horizontal shelves. Alternately the unit can be placed in a second position with the backing plate resting on the supporting structure whereby the shelves form dividers and the heretofore front edges of the side panels form upstanding flanges for suspending hanging files therefrom.

20 Claims, 20 Drawing Figures

DESK-TOP STORAGE UNIT

BACKGROUND OF THE INVENTION

1. Field of the Invention

The invention relates to storage units, and in particular to a readily assembled storage unit formed of a minimum of components, which components can be shipped in a disassembled condition and assembled easily by the interlocking engagement of various channels, grooves and tabs formed on the individual components, all of which can be mass produced of inexpensive plastic material. More particularly, the invention relates to such a storage unit which is adapted to be mounted on a desk and used as a desk tray for receiving letters, stationery and the like, or which can be placed in an alternate position and serve as a storage unit for hanging files.

2. Description of the Prior Art

There are numerous types, styles, constructions and arrangements of storage units which are adapted to be placed on a desk, bookcase or the like, which have a plurality of spaced, horizontal shelves for holding various materials such as letters, envelopes, stationery and incoming and outgoing mail. These storage units are formed of a variety of materials, such as wood, metal, plastic, or a combination thereof.

The use of plastic material for forming such storage units has become increasingly popular over the past years due to the strength of the plastic, reduced cost thereof, and light weight. These prior plastic storage units generally are formed of a plurality of separately molded components or parts which are secured together by an adhesive or ultrasonic welding. The units then are boxed and shipped to a distributor or retail sales outlet. It is relatively expensive to package and ship these assembled units due to their bulkiness. These assembled and boxed units also occupy a considerable amount of storage space in both the manufacturers' and distributors' warehouses and retail sales outlets.

Another type of storage unit that is used in many homes and offices is for hanging folders. These folders have two steel rods extending across the top edges of the folder jacket. The outer ends of the rods are bent downwardly and hook over rails extending along the drawer or file rack for suspending the folder therefrom. Storage units for these hanging file folders generally are the large metal file cabinets or may be smaller units formed of cardboard. However, these files require the use of additional metal rails which are mounted in the file for suspending the hanging folders therefrom.

Therefore, the need has existed for an inexpensive desk-top storage unit which can be shipped and stored in a disassembled state and assembled easily by the purchaser thereof, which can be used for a usual desk-top tray for holding papers, envelopes, etc. and which can also function as a storage unit for hanging file folders. There is no known desk-top storage unit of which I am aware which provides these features and accomplishes these results.

SUMMARY OF THE INVENTION

Objectives of the invention include providing a desk-top storage unit which is formed of a relatively few component parts, each of which can be mass produced relatively inexpensively by usual plastic molding procedures, and in which the unit can be shipped in disassembled condition and assembled easily and conveniently by the purchaser, thereby reducing the amount of storage space and size of shipping containers and associated costs. Another objective is to provide such a storage unit in which the component parts when assembled by the purchaser are interlocked with each other to form a rigid structure, in which a plurality of such individual storage units may be stacked one on top of the other to form a multi-tiered desk tray for receiving and storing papers, mail and other documents, and in which the unit can be placed in an alternate position to provide a storage file having various compartments for receiving hanging folders.

Still another objective of the invention is to provide such a storage unit which requires only three different components to form the complete storage unit or a combination of such storage units, and which components are provided with a plurality of channels, slots and projections enabling the unit to be assembled without using any adhesive, tapes or other materials for assembling the unit, and in which the units can be produced in various colors by the use of dyes in the raw plastic material from which the components are molded enabling the purchaser to match the decor of the office or home in which the unit will be used.

A further objective of the invention is to provide such a storage unit in which the three components include a side panel, a back panel, and a shelf, with an assembled unit consisting of two side panels, three shelves and a single back panel, in which the side panels are formed with a plurality of slots which are slidably engaged with channels formed on the edges of the shelves, in which the back panel also is engaged in channels formed on the rear edges of the side panels, and in which the back panel also has a plurality of holes through which tabs formed on the shelves project for interlocking the various components to form a sturdy assembled unit.

Another objective is to provide such a storage unit which is lightweight, rugged and relatively inexpensive, which eliminates difficulties heretofore encountered with prior storage units, which achieves the stated objectives simply and effectively, and which solves problems and satisfies needs existing in the art.

These objectives and advantages are obtained by the improved desk-top storage unit, the general nature of which may be stated as including a pair of similar side panels, each of said panels having front and rear edges, and formed with a plurality of spaced horizontally extending open-end slots, said slots extending from the panel rear edge toward the panel front edge, each of said panels having a channel formed on an inner surface adjacent the rear edge and extending vertically along said rear edge; a plurality of shelves having side edges and front and rear edges, each of said shelves being formed with channels along said side edges, each of said side edge channels being slidably engaged in a respective slot of the side panels to mount said shelves on the side panels with said shelves extending horizontally therebetween; a back panel having side edges, said side edges being received within the side panel channels for mounting the back panel on and extending between the side panels; and means formed on each of the shelves and engageable with the back panel for connecting said back panel with the shelves.

BRIEF DESCRIPTION OF THE DRAWINGS

A preferred embodiment of the invention, illustrative of the best mode in which applicant has contemplated applying the principles, is set forth in the following description and shown in the drawings and is particularly and distinctly pointed out and set forth in the appended claims.

Similar numerals refer to similar parts throughout the drawings.

DESCRIPTION OF THE PREFERRED EMBODIMENT

Figure 1:
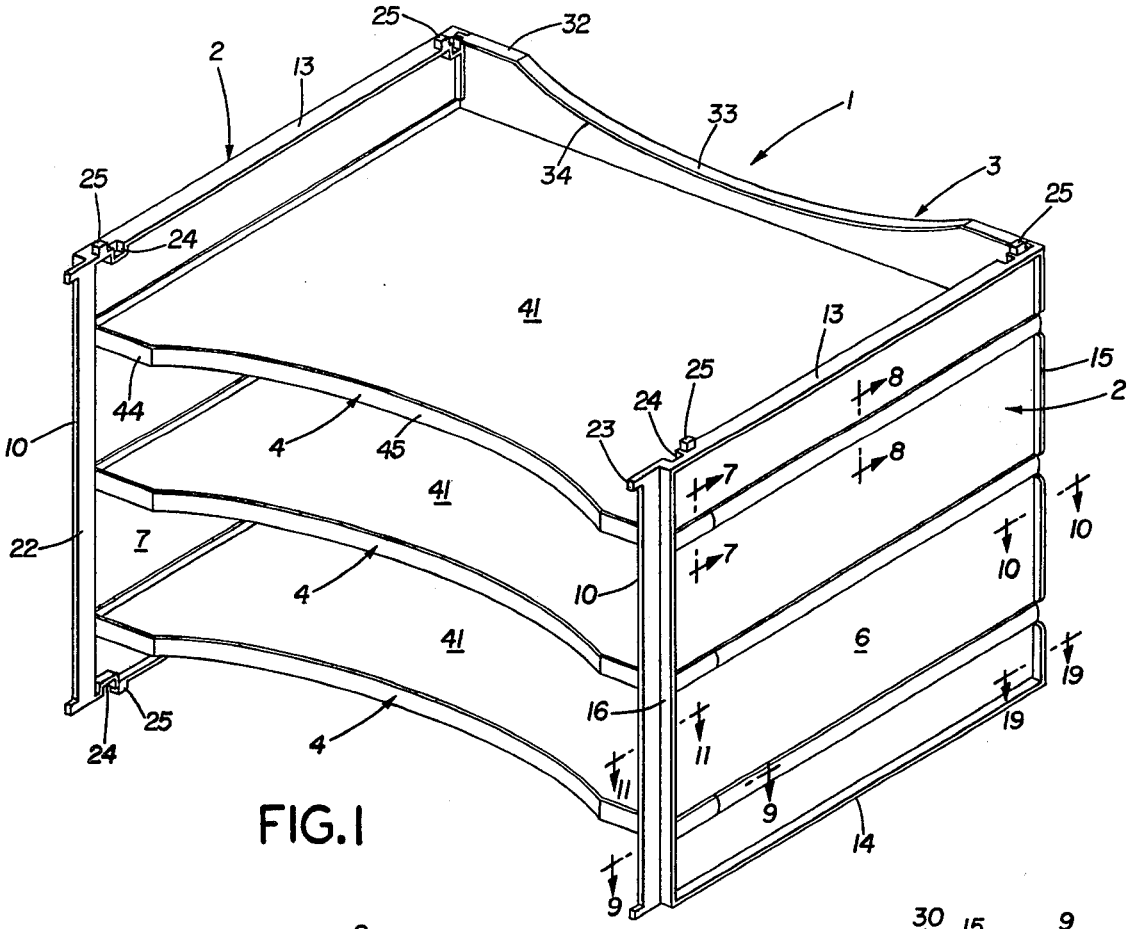
FIG. 1 is a perspective view of the improved desk-top storage unit.

The improved desk-top storage unit is shown in assembled position in FIG. 1 and placed so as to form a desk tray having a plurality of vertically spaced shelves for receiving paper, mail and similar items. Improved storage unit 1 is shown placed in its alternate position in FIG. 15 being used as a storage unit for hanging file folders.

Figure 2:
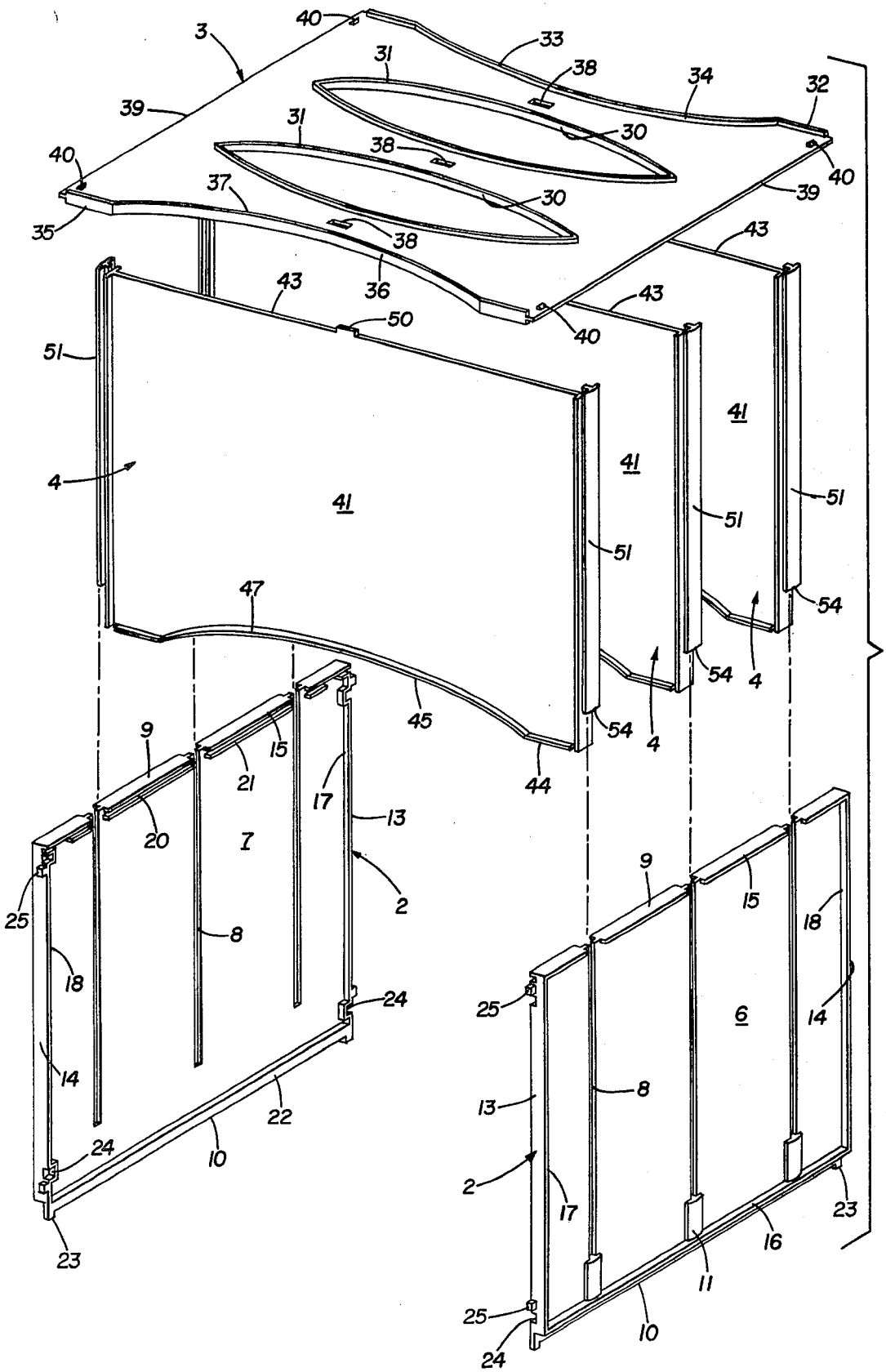
FIG. 2 is an exploded perspective view showing the individual components of the storage unit of FIG. 1.
Figure 3:
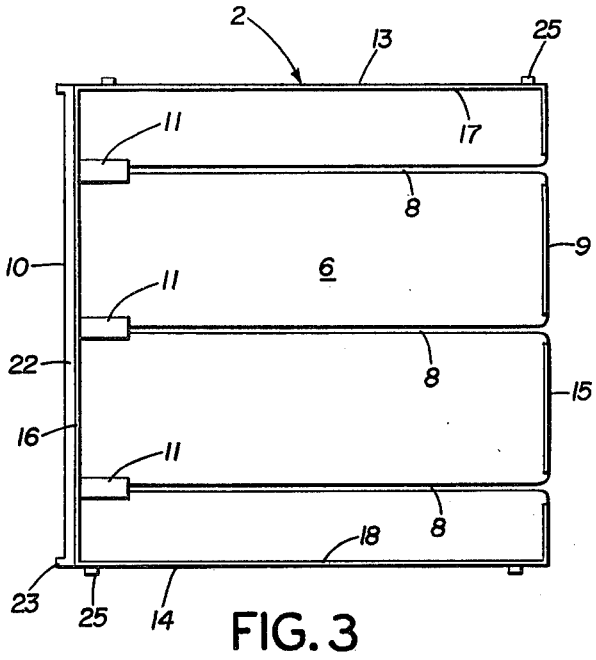
FIG. 3 is an elevational view of the outside surface of one of the side panels of the storage unit shown in FIGS. 1 and 2.
Figure 4:
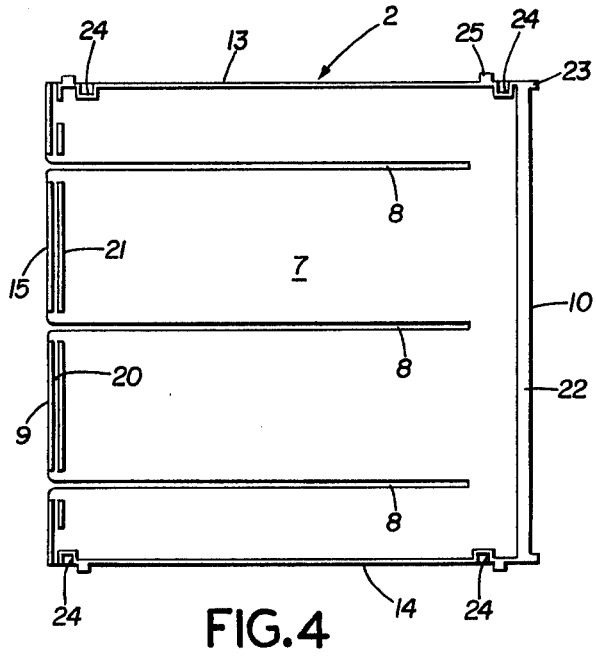
FIG. 4 is an elevational view of the inside surface of the side panel shown in FIG. 3.
Figure 5:
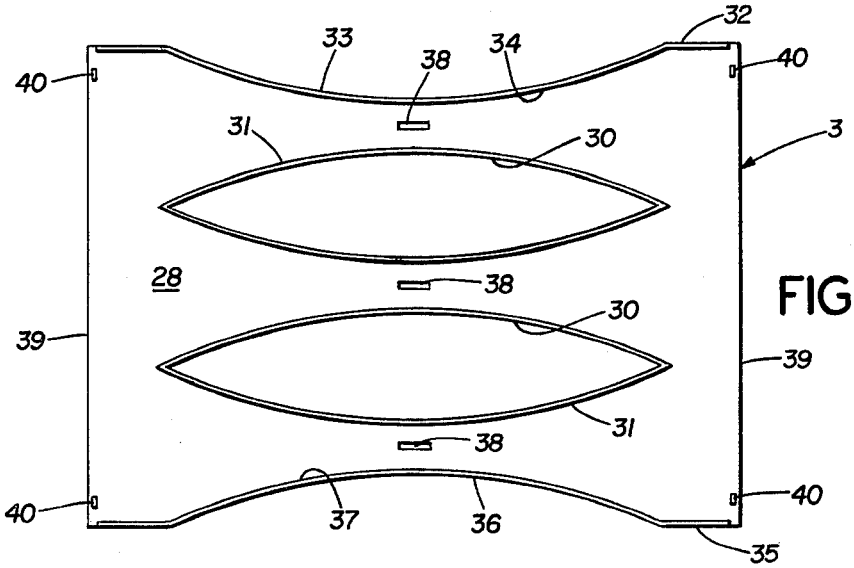
FIG. 5 is an elevational view of the rear panel of the storage unit shown in FIGS. 1 and 2.
Figure 6:
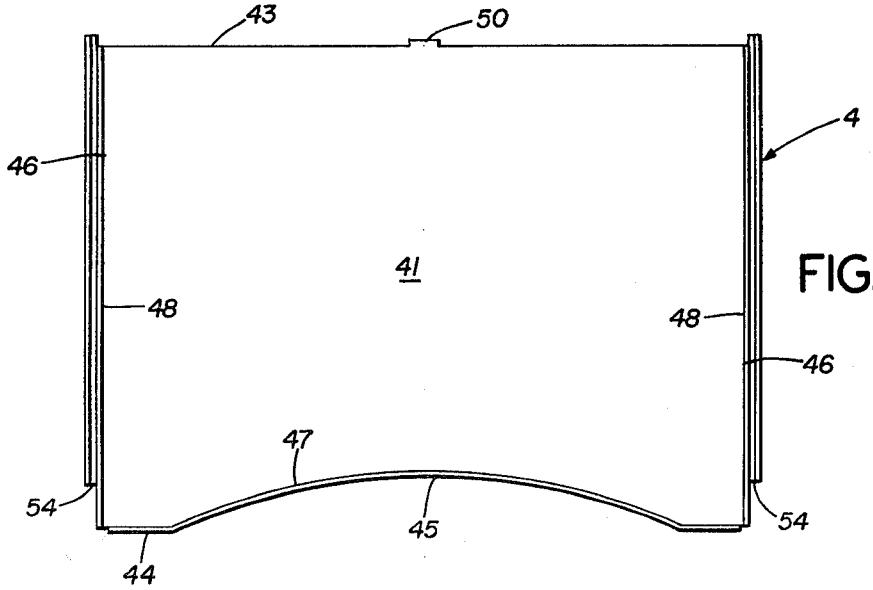
FIG. 6 is a top plan view of one of the shelves of the storage unit shown in FIGS. 1 and 2.

In accordance with one of the features of the invention, storage unit 1 is formed of only three separate components, shown individually in detail in FIGS. 2–6. The three components consist of a side panel indicated generally at 2 (FIGS. 3 and 4), a back panel indicated generally at 3 (FIG. 5) and a shelf indicated generally at 4 (FIG. 6). A completed storage unit 1 consists of two side panels 2, a single back panel 3 and three shelves 4, as shown in FIG. 2. Storage unit components 2, 3 and 4 preferably are molded of lightweight rugged plastic material in various colors and by usual plastic molding procedures and equipment.

The terms "front," "rear," "top," and "bottom" referred to below in describing storage unit 1 and the components thereof, pertain to the position that storage unit 1 will assume when functioning as a tray, as shown in FIG. 1, in which it will provide a plurality of vertically spaced horizontal storage shelves as opposed to the position it assumes in FIG. 15 where it will serve as a storage unit for hanging files. These designations are for clarity purposes only and it is readily understood that these will change when the storage unit is rotated 90° between its tray position of FIG. 1 to the hanging file position of FIG. 15.

Figure 7:
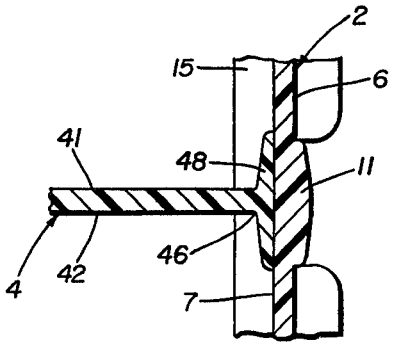
FIG. 7 is an enlarged fragmentary sectional view taken on line 7—7, FIG. 1.

Side panel 2 has a generally rectangular shape having an outer surface 6 (FIG. 3) and an inner surface 7 (FIG. 4). Panel 2 is formed with a plurality of open-ended spaced parallel slots 8 which extend horizontally from a rear edge 9 to front edge 10. Slots 8 extend from rear edge 9 forwardly to a position closely adjacent front edge 10. Thickened curved pads 11 are formed on outer surface 6 and extend between the front ends of slots 8 and edge 10 to provide strength to the side panel to prevent breakage in this relatively short area of material. Pads 11 are shown particularly in FIG. 7 and are molded integrally with outer surface 6 of side panel 2 and preferably have smooth curved convex configurations. Side panel 2 further includes a top edge 13 and a bottom edge 14. Peripheral reinforcing flanges 15, 16, 17 and 18 extend outwardly from surfaces 6 and 7 along rear and front edges 9 and 10, and along top and bottom edges 13 and 14, respectively.

Figure 11:
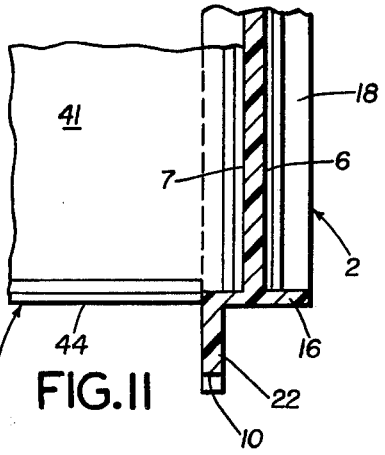
FIG. 11 is an enlarged fragmentary sectional view taken on line 11—11, FIG. 1.
Figure 12:
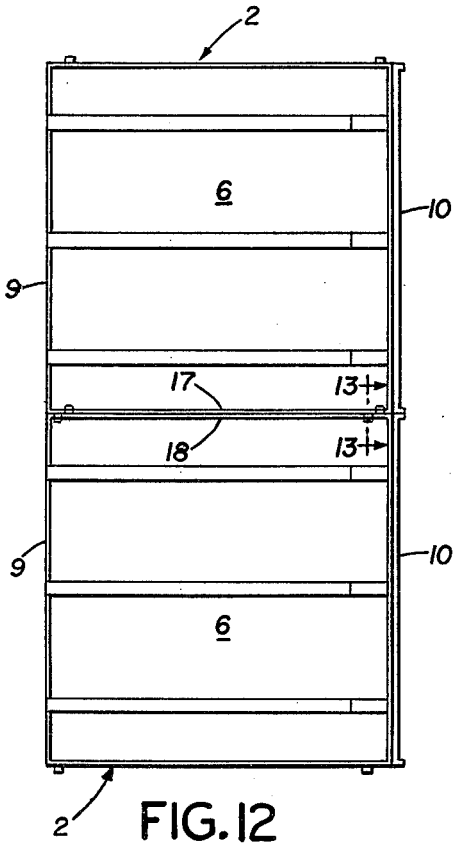
FIG. 12 is a reduced side elevational view of two of the storage units of FIG. 1 shown in interlocked stacked position.
Figure 13:
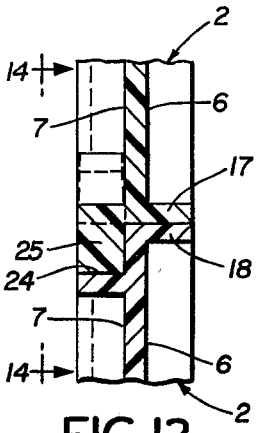
FIG. 13 is an enlarged fragmentary sectional view taken on line 13—13, FIG. 12.

A vertically extending channel 20 is formed along rear edge 9 of side panel 2, as shown in FIG. 4, between reinforcing rib 15 and a parallel spaced leg-forming projection 21 which projects outwardly from inner surface 7. Front edge 10 includes a forwardly projecting flange 22 (FIG. 11) which forms one of the hanging rails for supporting hanging file folders when storage unit 1 is used for this arrangement, as shown in FIGS. 15 and 16. Flange 22 terminates in end projections 23 which serve as stops for the hanging file folder hooks. A pair of rectangular-shaped sockets 24 are formed on inner surface 7 adjacent top and bottom edges 13 and 14 and rear and front edges 9 and 10. A pair of complementary-shaped lugs 25 having truncated configurations are formed on top and bottom reinforcing flanges 17 and 18 and project outwardly therefrom and are positioned adjacent sockets 24, as shown particularly in FIGS. 1 and 4. Lugs 25 are engageable in sockets 24 (FIG. 14) to enable a plurality of units 1 to be either stacked vertically as shown in FIG. 12 or to be placed horizontally with respect to each other when unit 1 is used as a hanging file storage unit.

Back panel 3 (FIG. 5) has a flat configuration with inner and outer surfaces 28 and 29 which are similar to each other. A pair of somewhat oval-shaped openings 30 are formed in back panel 3 and are defined by reinforcing ribs 31 which extend about the periphery of openings 30 on both surfaces 28 and 29. Top edge 32 of back panel 3 is formed with a reinforcing rib 34 and has a concave central portion 33. Bottom edge 35 also is formed with a reinforcing rib 37 similar to rib 34 of top edge 32 and has a convex central portion 36. Three elongated rectangular-shaped slots 38 are formed in rear panel 3 and are spaced vertically, as shown in FIG. 5. Back panel 3 preferably will have the same thickness as side panels 2. A small projection 40 is formed adjacent each corner of back panel surfaces 28 and 29 to provide locking tabs when assembled with side panels 2, as described below.

Figure 17:
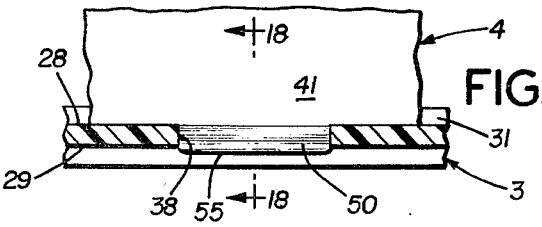
FIG. 17 is an enlarged fragmentary sectional view taken on line 17—17, FIG. 15.
Figure 18:
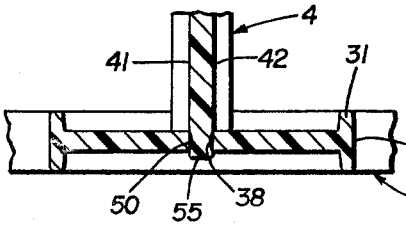
FIG. 18 is a fragmentary sectional view taken on line 18—18, FIG. 17.

Shelf 4 (FIG. 6) has a flat configuration with similar top and bottom surfaces 41 and 42 and a straight rear edge 43 and a front edge 44. Front edge 44 has a concave inwardly curved front portion 45, and is connected to rear edge 43 by side edges 46. Front edge 44 and side edges 46 are formed with reinforcing flanges 47 and 48, respectively. A small outwardly projecting tab 50 is formed on rear edge 43 and is complementary to and is adapted to be engaged in a slot 38 of back panel 3 when in assembled condition, as shown in FIGS. 17 and 18. A T-shaped channel-forming member 51 is formed on each side edge 46 and forms upper and lower channels 52 and 53 (FIG. 8) into which the edges of side panel slot 8 are engaged for mounting of shelves 4 on and extending between a pair of side panels 2. Shelf 4 preferably will have a slightly greater thickness than the thickness of side panels 2 and rear panel 3 to provide sufficient rigidity for supporting a sufficient quantity of papers, envelopes, etc. when used as a desk tray.

Figure 8:
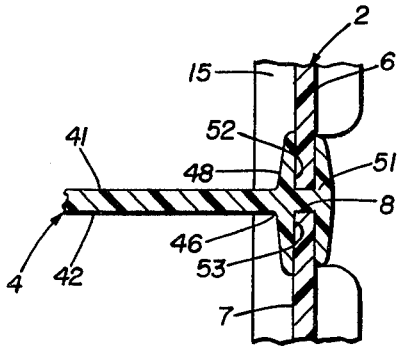
FIG. 8 is an enlarged fragmentary sectional view taken on line 8—8, FIG. 1.
Figure 9:
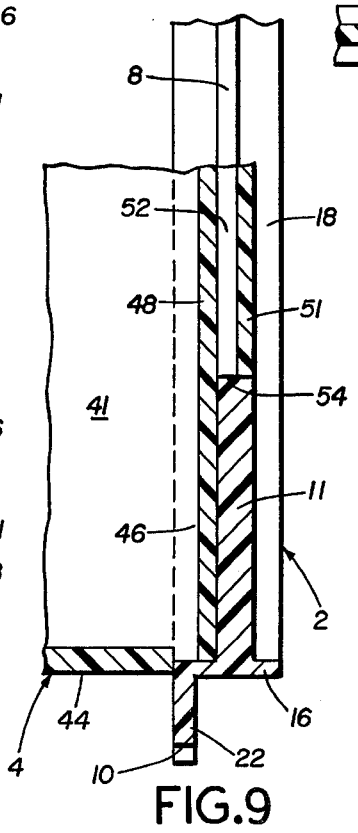
FIG. 9 is an enlarged fragmentary sectional view taken on line 9—9, FIG. 1.
Figure 10:
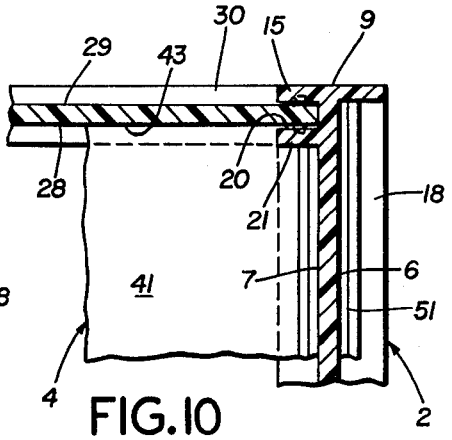
FIG. 10 is an enlarged fragmentary sectional view taken on line 10—10, FIG. 1.
Figure 19:
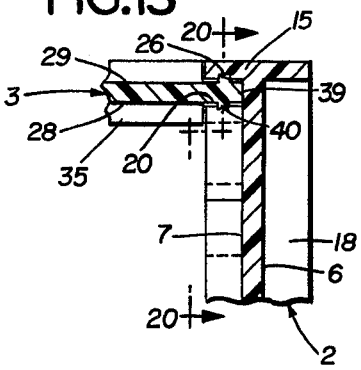
FIG. 19 is an enlarged fragmentary sectional view taken on line 19—19, FIG. 1.
Figure 20:
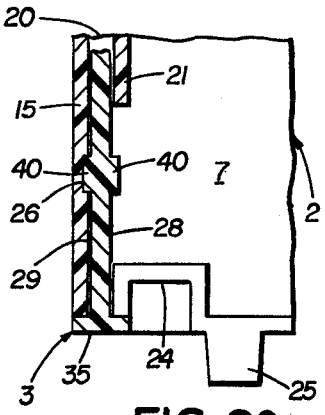
FIG. 20 is a fragmentary sectional view taken on line 20—20, FIG. 19.

In accordance with one of the main features of the invention, improved storage unit 1 may be shipped in disassembled condition in a relatively small flat box and will consist of two side panels 2, a single back panel 3 and three shelves 4, as shown in FIG. 2. The method of assembly is shown generally in FIG. 2 and is described below. The T-shaped channel-forming members 51 of shelves 4 are slidably engaged in slots 8 of side panels 2. The edges of panel 3 which define slots 8 are engaged in channels 52 and 53 formed by T-shaped member 51, as shown in FIG. 8. The forward edges 54 of T-shaped members 51 abut against pads 11, as shown in FIG. 9, Next, side edges 39 of back panel 3 are inserted into channels 20 (FIG. 10) which extend vertically along the rear edge 9 of side panels 2. Edges 39 are engaged in channels 20 easily by bowing back panel 3 slightly outwardly after which a downward force on the center of the back panel will move edges 39 outwardly into engagement with the bottom of channels 20. This downward pressure on back panel 3 will force shelf tabs 50 through back panel slots 38 (FIGS. 17 and 18). Tabs 50 have slightly enlarged outer ends 55 which will "pop" through openings 38 and securely lock back panel 2 with shelves 4 at each tab location. Also, locking projections 40 formed on the inner and outer surfaces of back panel 3 snap into engagement with notches 26 formed in the ends of reinforcing flanges 15 which are one of the channel-forming walls of side panel channels 20 (FIGs. 19 and 20). This further assists in securely locking back panel 3 with side panels 2 in addition to the engagement of panel edges 39 in channels 20.

Figure 15:
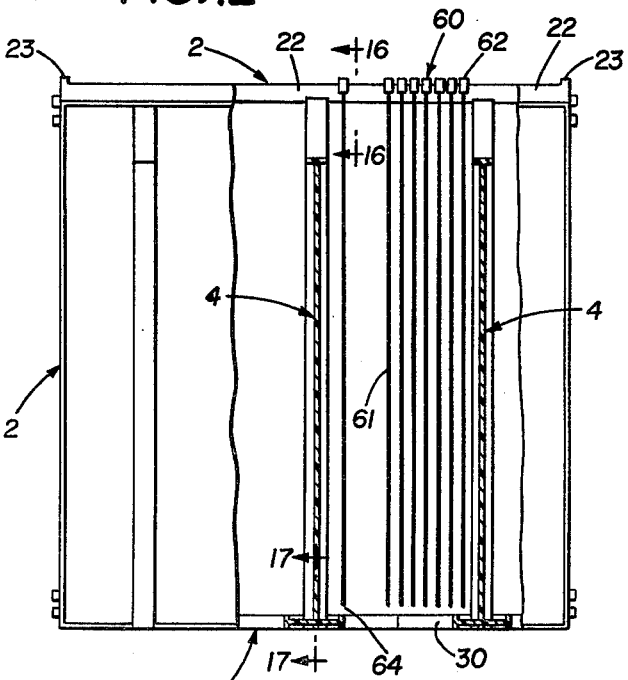
FIG. 15 is a side elevational view with portions broken away and in section showing the storage unit of FIG. 1 in an alternate position for storing a plurality of hanging file folders.
Figure 16:
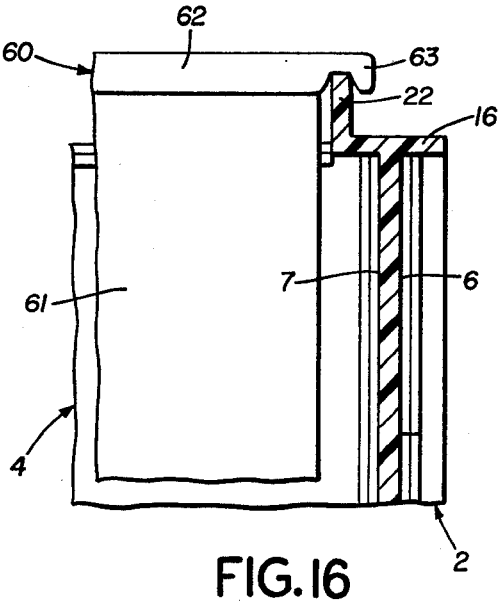
FIG. 16 is an enlarged fragmentary sectional view taken on line 16—16, FIG. 15.

In accordance with another feature of the invention, storage unit 1 also may be used as a file for storing hanging file folders, indicated generally at 60 and shown in FIGS. 15 and 16. Each folder 60 is an envelope-shaped member 61 having a closed bottom end 64 and a pair of metal supporting bars 62 which terminate in bent end tabs 63. Tabs 63 are slidably mounted on and extend between front edge flanges 22 of spaced side panels 2. File folders 60 extend downwardly into the spaces between shelves 4 which now form vertical compartment separators, as shown in FIG. 15. End projections 23 of flange 22 serve as stops to prevent the hanging file folders from sliding off the edges of supporting flanges 22.

Figure 14:
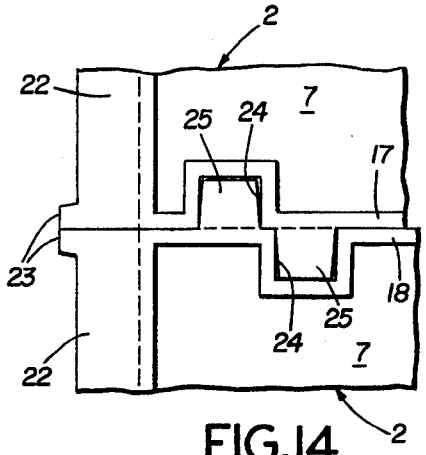
FIG. 14 is a fragmentary plan view looking in the directon of arrows 14—14, FIG. 13.

In order to use storage unit 1 as a file for hanging folders, the unit is merely rotated 90° with back panel 3 becoming the bottom of the storage unit. The openings between shelves 4 provide top openings into which file folders 60 are inserted when suspended from flanges 22. A plurality of storage units 1 may be interlocked and extend in a horizontal direction by the engagement of lugs 25 in notches 24, as shown in FIG. 14, to provide a longer horizontal file for hanging folders 60, in a similar manner as when the storage units are stacked vertically when functioning as desk trays, as shown in FIG. 12.

Accordingly, the improved storage unit is simplified, provides an effective, safe, inexpensive, and efficient device which achieves all the enumerated objectives, provides for eliminating difficulties encountered with prior storage units, and solves problems and obtains new results in the art.

In the foregoing description, certain terms have been used for brevity, clearness and understanding, but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved desk-top storage unit is constructed and used, the characteristics of the construction, and the advantageous, new and useful results obtained, the new and useful structures, devices, elements, arrangements, parts, and combinations, are set forth in the appended claims.

I claim:

1. A readily assembled desk-top storage unit including:

(a) a pair of similar side panels, each of said panels having front and rear edges, and formed with a plurality of spaced horizontally extending open-end slots, said slots extending from the panel rear edge toward the panel front edge, each of said panels having a channel formed on an inner surface adjacent the rear edge and extending vertically along said rear edge;

(b) a plurality of shelves having side edges and front and rear edges, each of said shelves being formed with channels along said side edges, each of said side edge channels being slidably engaged in a respective slot of the side panels to mount said shelves on the side panels with said shelves extending horizontally therebetween;

(c) a back panel having side edges, said side edges being received within the side panel channels for mounting the back panel on and extending between the side panels; and (d) means formed on each of the shelves and engageable with the back panel for connecting said back panel with the shelves.

2. The storage unit defined in claim 1 in which the back panel is formed with a plurality of vertically spaced holes; and in which each of the shelves is formed with a tab projecting outwardly from the rear edge, said tabs being complementary with the back panel holes and engageable with said holes to provide the means for connecting the back panel with the shelves.

3. The storage unit defined in claim 2 in which the shelf tab-receiving holes that are formed in the back panel are elongated slots.

4. The storage unit defined in claim 2 in which each of the shelf tabs is positioned in the center of the rear edge of the shelf and has an elongated configuration.

5. The storage unit defined in claim 2 in which the shelf tabs are formed with enlarged outer ends.

6. The storage unit defined in claim 1 in which the back panel is formed with enlarged openings, each of said openings being located between a pair of shelves; and in which reinforcing ribs are formed on the back panel and extend about the openings to increase the stiffness of said back panel.

7. The storage unit defined in claim 1 in which the back panel has top and bottom edges; in which the top edge is formed with a concavely shaped central portion and in which the bottom edge is formed with a convexly shaped central portion.

8. The storage unit defined in claim 1 in which the side panels each has inner and outer surfaces; in which a plurality of pads are formed on the outer surface of each of the side panels; and in which a respective pad is located between the forward end of each slot and the front edge of said side panel.

9. The storage unit defined in claim 8 in which the pads have a smooth curved convex shape.

10. The storage unit defined in claim 1 in which each of the side panels has an outwardly projecting reinforcing flange extending generally about the periphery of each side panel.

11. The storage unit defined in claim 1 in which each of the side panels is formed with a flange which projects outwardly beyond the front edge of said panel.

12. The storage unit defined in claim 1 in which the front and side edges of each shelf is provided with a reinforcing flange.

13. The storage unit defined in claim 1 in which the front edge of each shelf is formed with a concavely shaped central portion.

14. The storage unit defined in claim 1 in which the rear end of the side edge shelf channels extends rearwardly beyond the rear edge of the shelf and in which the front end terminates rearwardly of the front edge of the shelf.

15. The storage unit defined in claim 1 in which there are three shelves equally spaced vertically with respect to each other; in which the topmost shelf is spaced vertically below the top edges of the side panels and back panel; and in which the bottom-most shelf is spaced vertically above the bottom edge of the side panels and back panel.

16. The storage unit defined in claim 1 in which the top and bottom edges of each side panel are formed with a pair of spaced sockets and pairs of upstanding lugs, each of said lugs being located adjacent a respective one of the sockets and complementary to said sockets, said lugs of one side panel being adapted to be received in the sockets of another side panel located vertically with respect to said one side panel for vertically stacking a pair of storage units.

17. The storage unit defined in claim 16 in which the sockets and lugs are located adjacent the front and rear of the side panel top and bottom edges; and in which the lugs have a generally truncated configuration.

18. The storage unit defined in claim 1 in which the side panels, shelves and back panel are formed of a plastic material.

19. The storage unit defined in claim 1 in which a plurality of locking projections are formed on the back panel; in which a reinforcing flange extends along the rear edge of each side panel; and in which notches are formed at spaced locations in the reinforcing flange in which the projections are engaged to assist in locking the back panel to the side panels.

20. The storage unit defined in claim 1 in which the side edge shelf channels are formed by T-shaped members formed integrally with the shelf edges.

* * * * *